US009002220B2

(12) United States Patent
Ishihara et al.

(10) Patent No.: US 9,002,220 B2
(45) Date of Patent: Apr. 7, 2015

(54) FIXING DEVICE AND IMAGE FORMATION APPARATUS

(75) Inventors: Yasuhiro Ishihara, Toyohashi (JP); Hiroyuki Yoshikawa, Toyohashi (JP); Kosuke Sasaki, Toyokawa (JP); Isao Watanabe, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 569 days.

(21) Appl. No.: 13/236,692

(22) Filed: Sep. 20, 2011

(65) Prior Publication Data

US 2012/0076521 A1 Mar. 29, 2012

(30) Foreign Application Priority Data

Sep. 29, 2010 (JP) ..... 2010-218348

(51) Int. Cl.
*G03G 15/20* (2006.01)
*G03G 15/00* (2006.01)

(52) U.S. Cl.
CPC ..... *G03G 15/2039* (2013.01); *G03G 15/553* (2013.01); *G03G 15/55* (2013.01)

(58) Field of Classification Search
USPC ..... 399/33, 69, 70
See application file for complete search history.

(56) References Cited

U.S. PATENT DOCUMENTS

| | | | | |
|---|---|---|---|---|
| 6,006,051 | A * | 12/1999 | Tomita et al. | 399/69 |
| 6,222,158 | B1 | 4/2001 | Nakata et al. | |
| 2009/0245900 | A1 | 10/2009 | Kagawa | |

FOREIGN PATENT DOCUMENTS

| | | | |
|---|---|---|---|
| JP | 06-202512 | A | 7/1994 |
| JP | 08-185070 | A | 7/1996 |
| JP | 2005-049641 | A | 2/2005 |
| JP | 2007-187973 | A | 7/2007 |
| JP | 2008-40097 | A | 2/2008 |
| JP | 2009-192993 | A | 8/2009 |
| JP | 2009-244595 | A | 10/2009 |

OTHER PUBLICATIONS

Muto (JP 08-185070 A), Jul. 1996, JPO Computer Translation.*

(Continued)

*Primary Examiner* — Erika J Villaluna
(74) *Attorney, Agent, or Firm* — Buchanan Ingersoll & Rooney PC

(57) ABSTRACT

A fixing device for fixing an unfixed toner image on a recording sheet by passing the recording sheet through a fixing nip and applying heat and pressure to the recording sheet, the fixing device comprising: a heater including a resistance heater part and a supporting member, the resistance heater part having a positive resistance-temperature characteristic in a temperature range above a predetermined level, and the supporting member being insulative and supporting the resistance heater part such that the resistance heater part applies heat to the recording sheet; a current detector detecting a current supplied to the resistance heater part; and an abnormality determiner determining whether the resistance heater part has an abnormality, based on an initial current detected by the current detector at a predetermined time after a beginning of power supply to the resistance heater part and before the temperature of the resistance heater part reaches the predetermined level.

11 Claims, 7 Drawing Sheets

(56) References Cited

OTHER PUBLICATIONS

Nishimura (JP 2009-192993 A) Aug. 2009, JPO Computer Translation.*

Office Action (Notification of Reasons for Refusal) dated Nov. 13, 2012, issued by the Japanese Patent Office in the corresponding Japanese Patent Application No. 2010-218348 and an English translation thereof. (6 pages).

* cited by examiner

FIXING DEVICE AND IMAGE FORMATION APPARATUS

This application is based on application No. 2010-218348 filed in Japan, the content of which is hereby in incorporate reference.

BACKGROUND OF THE INVENTION (1) Field of the Invention

The present invention relates to a fixing device for fixing an unfixed image formed on a recording sheet onto the recording sheet by applying heat to the unfixed image, and relates to an image formation apparatus provided with the fixing device.

(2) Related Art

In electrophotographic image formation apparatuses such as printers and copiers, usually, a toner image corresponding to image data is transferred onto a recording sheet, such as a sheet of recording paper and an OHP sheet, and then a fixing device fixes the toner image transferred onto the recording sheet. The fixing device fixes the toner image onto the recording sheet by applying heat to the toner image on the recording sheet and pressure to the recording sheet.

Patent Literature 1 (Japanese Patent Application Publication No. 2008-40097) discloses a fixing device provided with a heater (heating sheet) which includes an insulating substrate and a resistance heating element disposed thereon. The resistance heating element has a positive temperature coefficient of resistance. In this fixing device, a heating roller is provided so as to face the heater, and a fixing film having a strip-like shape is provided so as to be movable between the heater and the heating roller. The recording sheet passes through a fixing nip between the fixing film and the heating roller.

The resistance heating element has a positive temperature coefficient of resistance, and usually, the resistance of the resistance heating element gradually decreases until its temperature reaches a certain point. When the temperature reaches a point near the Curie temperature (Curie point), its electrical resistance rises sharply. In consequence, current supply to the resistance heating element will be reduced.

Patent Literature 2 (Japanese Patent Application Publication No. 2009-244595) discloses a fixing device provided with a heating sheet as a heater, which includes an insulating substrate and a resistance heating element disposed thereon. The resistance heating element of the heating sheet is divided into portions in the longitudinal direction. The portions of the resistance heating element are connected in parallel, and a PTC element is serially connected to each resistance heating element. Note that PTC elements are characterized in that the resistance increases when the temperature exceeds a certain point (Curie temperature). In each serial connection, current is independently supplied to the portion of resistance heating element and the PTC element.

With the structures of Patent Literatures 1 and 2, the fixing device is provided with the resistance heating element as described above. Hence, unlike conventional fixing devices using a halogen lamp or the like as a heater, the fixing device needs not to control the fixing temperature by using a temperature detection element. Hence, the fixing device needs not to be provided with a controller for controlling a halogen lamp or the like as a heater. Therefore, it is unnecessary to use an expensive temperature detection element such as a thermopile, and the fixing device is economical. Furthermore, since the controller is unnecessary, there is no risk that runaway occurs in the control unit due to software bugs or electrical noise and the temperature of the heater reaches a dangerous level in a short period.

However, since the heaters (heating sheets) used in Patent Literatures 1 and 2 have a strip-like structure in which a thick-film resistance heating element is provided on the insulating substrate, there is a risk for the occurrence of breakage such as a crack in the insulating substrate due to physical vibration to the heater (heating sheet) or thermal stress caused at a high temperature equal to or higher than 150° C. A crack in the insulating substrate would lead to the occurrence of a rupture in the resistance heating element on the insulating substrate, and would make it impossible to supply power to the resistance heating element.

If it is impossible to supply power to the resistance heating element, it is impossible to cause the resistance heating element to generate heat. This causes, for example, a fixing failure, which is a problem that a toner image on the recording sheet can not be surely fixed on the recording sheet.

In addition, since the structures disclosed in Patent Literatures 1 and 2 do not include any temperature detection element such as a thermistor and a thermopile, the devices can not detect the abnormality that the resistance heating element is not supplied with power and the resistance heating element does not generate heat. However, if a temperature detection element such as a thermistor and a thermopile is adopted to monitor the temperature of the heater (heating sheet) and detect an abnormality in the resistance heating element, the cost efficiency will be compromised.

In particular, in the case of the structure disclosed in Patent Literature 2 for example, where each portion of the resistance heating element is separately supplied with power, it is necessary to monitor the temperature of each portion of the resistance heating element in order to detect an abnormality in each resistance heating element. If many temperature detection elements are adopted for monitoring the temperature of each portion of the resistance heating element, this significantly compromises the cost efficiency.

SUMMARY OF THE INVENTION

The present invention is made in view of the problems described above. The present invention aims to provide a fixing device that is capable of preventing excessive increase in temperature above a predetermined level by using a resistance heater part with a PTC characteristic instead of a temperature detection element, and of detecting an abnormality that the resistance heater is not supplied with power, without compromising the cost efficiency. The present invention also aims to provide an image formation apparatus having such a fixing device.

To achieve the aim above, one aspect of the present invention provides a fixing device for fixing an unfixed toner image formed on a recording sheet by passing the recording sheet through a fixing nip and applying heat and pressure to the recording sheet, the fixing device comprising: a heater including a resistance heater part and a supporting member, the resistance heater part having a positive resistance-temperature characteristic in a temperature range above a predetermined level and exhibiting a nonlinear change in resistance when a temperature thereof exceeds the predetermined level, and the supporting member being insulative and supporting the resistance heater part such that the resistance heater part applies heat to the recording sheet passing through the fixing nip; a current detector detecting a current supplied to the resistance heater part; and an abnormality determiner determining whether the resistance heater part has an abnormality, based on an initial current detected by the current detector at a predetermined time after a beginning of power supply to the resistance heater part and before the temperature of the resistance heater part reaches the predetermined level.

An image formation apparatus pertaining to the present invention is characterized in having the fixing device described above.

BRIEF DESCRIPTION OF THE DRAWINGS

These and the other objects, advantages and features of the invention will become apparent from the following description thereof taken in conjunction with the accompanying drawings which illustrate specific embodiments of the present invention.

In the Drawings.

DESCRIPTION OF PREFERRED EMBODIMENTS

The following describes an embodiment of the fixing device and the image formation apparatus pertaining to the present invention.

<Overall Structure of Image Formation Apparatus>

Figure 1:
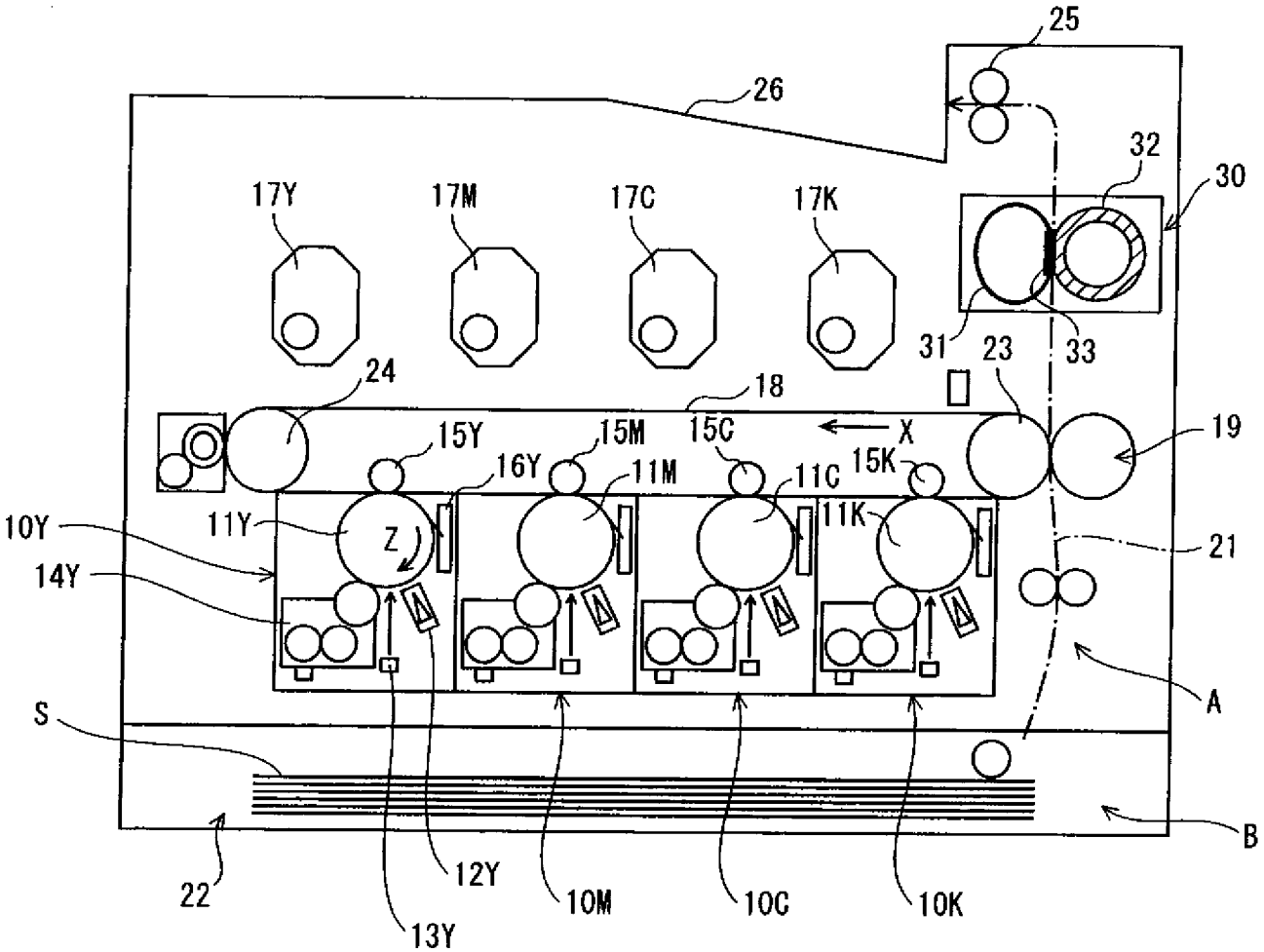
FIG. 1 is a schematic diagram showing the structure of a printer as an example of an image formation apparatus provided with a fixing device pertaining to Embodiment of the present invention.

FIG. 1 is a schematic diagram showing the structure of a tandem color printer (hereinafter simply referred to as "printer") as an example of an image formation apparatus provided with a fixing device pertaining to an embodiment of the present invention. This color printer forms a full-color or monochrome image on a recording sheet such as a sheet of recording paper or an OHP sheet, by a well-known electrophotographic method, based on image data or the like input from an external terminal device or the like via a network (for example, LAN).

The printer includes an image formation section A and a paper feed section B. The image formation section A forms toner images of the colors yellow (Y), magenta (M), cyan (C), and black (K) on a recording sheet. The paper feed section B is located below the image formation section A. The paper feed section B includes a paper feed cassette 22 that contains recording sheets S, and the recording sheets S in the paper feed cassette 22 are fed to the image formation section A.

The image formation section A is provided with a pair of belt conveyor rollers 23 and 24 and an intermediate transfer belt 18. The intermediate transfer belt 18 is provided almost in the middle of the printer, and is wound around the belt conveyor rollers 23 and 24, so as to be positioned horizontally, and rotates around the rollers. The intermediate transfer belt 18 is rotated in the direction indicated by the arrow X by a motor not shown in the drawing.

Process units 10Y, 10M, 10C and 10K are provided below the intermediate transfer belt 18. The process units 10Y, 10M, 10C and 10K are arranged in this order, along the direction of the rotation of the intermediate transfer belt 18. The process units 10Y, 10M, 10C and 10K form toner images on the intermediate transfer belt 18 by using toner of their respective colors, namely yellow (Y), magenta (M), cyan (C), and black (K). The process units 10Y, 10M, 10C and 10K are each detachable from the image formation section A.

Above the intermediate transfer belt 18, toner containers 17Y, 17M, 17C and 17K are provided such that the toner containers 17Y, 17M, 17C and 17K are respectively located above the process units 10Y, 10M, 10C and 10K, with the intermediate transfer belt 18 therebetween. The process units 10Y, 10M, 10C and 10K are supplied with toner of their respective colors, namely yellow (Y), magenta (M), cyan (C) and black (K), respectively contained in the toner containers 17Y, 17M, 17C and 17K.

Apart from using a different color toner supplied from a different toner container, namely the toner container 17Y, 17M, 17C or 17K, the process units 10Y, 10M, 10C, and 10K have the same structure. Accordingly, the following description mainly focuses on the process unit 10Y, and description of the other process units 10M, 10C and 10K is omitted.

The process unit 10Y has a photosensitive drum 11Y, which is provided below the intermediate transfer belt 18 so as to face the intermediate transfer belt 18 and to be rotatable. The photosensitive drum 11Y is rotated in the direction indicated by the arrow Z. The process unit 10Y also has a charger 12Y that is located below the photosensitive drum 11Y and uniformly charges the surface of the photosensitive drum. The charger 12Y faces the photosensitive drum 11Y.

The process unit 10Y further has an exposure device 13Y and a developing device 14Y. The exposure device 13Y is located downstream from the charger 12Y with respect to the rotation direction of the photosensitive drum 11Y and below the photosensitive drum 11Y in the vertical direction. The developing device 14Y is located downstream from the location on the surface of the photosensitive drum 11Y where is to be exposed by the exposure device 13Y, with respect to the rotation direction of the photosensitive drum 11Y.

The exposure device 13Y forms an electrostatic latent image on the surface of the photosensitive drum 11Y which has been uniformly charged by the charger 12Y, by irradiating the surface with a laser beam. The developing device 14Y develops the electrostatic latent image formed on the surface of the photosensitive drum 11Y by using Y color toner.

A primary transfer roller 15Y is provided above the process unit 10Y. The primary transfer roller 15Y faces the photosensitive drum 11Y, with the intermediate transfer belt 18 therebetween. The primary transfer roller 15Y is attached to the image formation section A, and forms an electric field between the primary transfer roller 15Y and the photosensitive drum 11Y by being applied with a transfer bias voltage.

Note that above the other process units 10M, 10C and 10K, the primary transfer rollers 15M, 15C and 15K are provided so as to face the photosensitive drums 11M, 11C and 11K respectively, with the intermediate transfer belt 18 therebetween.

The toner images formed on the photosensitive drums 11Y, 11M, 11C and 11K are subject to primary transfer to the intermediate transfer belt 18 by the effect of the electric fields formed between the primary transfer rollers 15Y, 15M, 15C and 15K and the photosensitive drums 11Y, 11M, 11C and 11K.

In the case of full-color image formation, the process units 10Y, 10M, 10C and 10K perform their image formation operations at different timings, so that the toner images respectively formed on the photosensitive drums 11Y, 11M, 11C and 11K are transferred onto the same area on the intermediate transfer belt 18.

On the other hand, in the case of monochrome image formation, only one selected process unit (e.g. process unit 10K for K toner) operates to form an toner image on the photosensitive drum (e.g. photosensitive drum 11K) corresponding to the selected process unit, and the toner image so formed is transferred to a predetermined area on the intermediate transfer belt by the primary transfer roller 15K facing the process unit.

Note that the process unit 10Y is provided with a cleaning member 16Y for cleaning the photosensitive drum 11Y onto which the toner image has been transferred.

A secondary transfer roller 19 is provided near the downstream edge of the intermediate transfer belt 18 on which the toner image has been formed. The downstream edge is downstream with respect to the transport direction of the intermediate transfer belt 18 (the right edge in FIG. 1). The secondary transfer roller 19 faces the intermediate transfer belt 18, with a sheet transport passage 21 therebetween. The secondary transfer roller 19 is pressed against the intermediate transfer belt 18, and a transfer nip is formed between them. The secondary transfer roller 19 is applied with a transfer bias voltage, and thus a electric field is formed between the secondary transfer roller 19 and the intermediate transfer belt 18.

The transfer nip formed by the secondary transfer roller 19 and the intermediate transfer belt 18 is supplied with a recording sheet S, which has been taken out of the paper feed cassette 22 of the paper feed section B and has been supplied to the sheet transport passage 21. The toner image transferred onto the intermediate transfer belt 18 is subject to secondary transfer onto the recording sheet S, which is transported along the sheet transport passage 21, by the effect of the electric field formed between the secondary transfer roller 19 and the intermediate transfer belt 18.

The recording sheet S passing through the transfer nip is transported to the fixing device 30 located above the secondary transfer roller 19. In the fixing device 30, the unfixed toner image on the recording sheet S is fixed by applying heat and pressure. The recording sheet S, onto which the toner image has been fixed, is ejected by a paper ejecting roller 25 onto a catch tray 26 which is located above the toner containers 17Y, 17M, 17C and 17K.

<Structure of Fixing Device>

Figure 2:
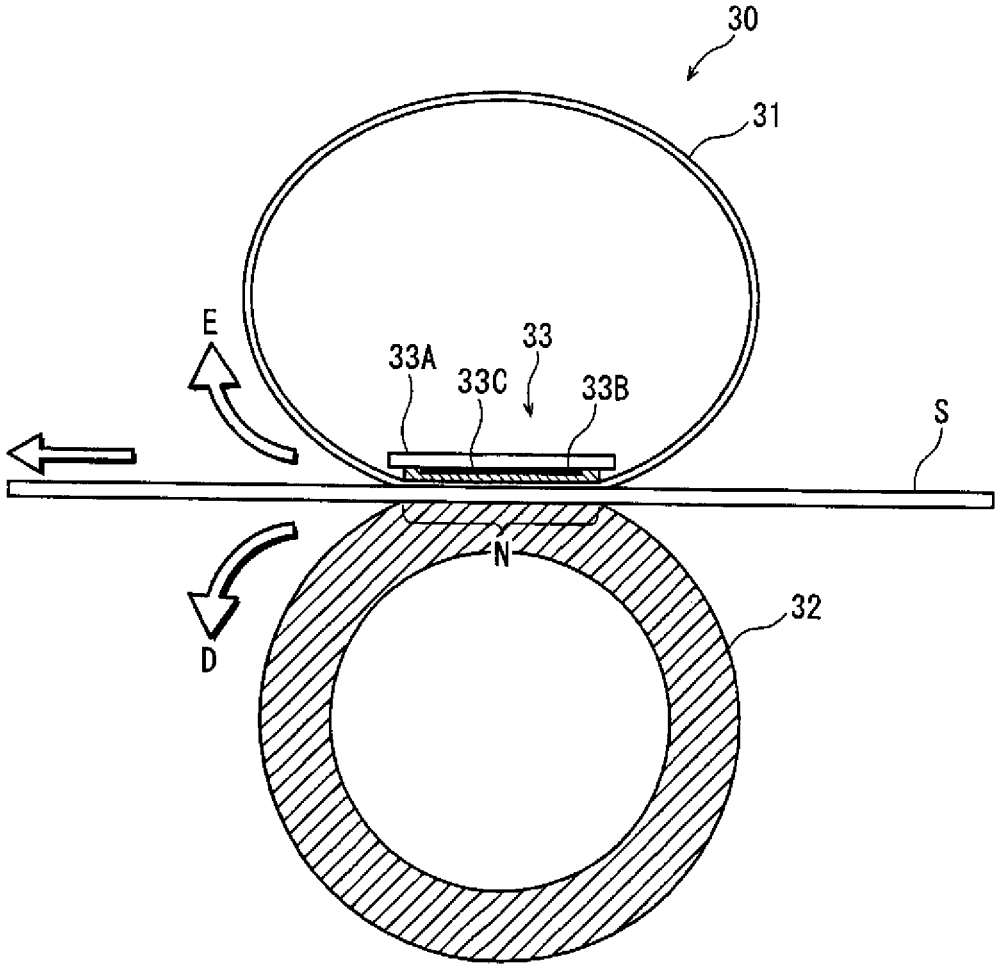
FIG. 2 is a schematic cross-sectional view showing the structures of primary elements of the fixing device provided in the printer.

FIG. 2 is a cross-sectional view showing the structures of primary elements of the fixing device 30. Note that although the recording sheet is transported from bottom to top in the fixing device 30 as shown in FIG. 1, FIG. 2 illustrates the fixing device 30 such that the recording sheet is transported from the left to the right on the drawing.

As shown in FIG. 2, the fixing device 30 includes a pressure roller 32, a belt member 31, and a heater 33. The pressure roller 32 serves as a member for applying pressure. The belt member 31 has a cylindrical shape and is rotatable (in circumferential movement) under the condition that the belt member 31 is pressed against the pressure roller 32. The heater has a strip-like shape and is located inside the rotation area (circumferential movement area) of the belt member 31 so as to be pressed against the inner circumferential surface of the belt member 31.

The belt member 31 is formed by winding a strip-like heat-resistant film so as to have an endless, cylindrical shape. The heater 33 located in the rotation area of the belt member 31 is pressed against the inner circumferential surface of the belt member 31.

The heater 33 is provided such that its longitudinal direction is perpendicular to the transport direction of the recording sheet S. The heater 33 faces the pressure roller 32 with the belt member 31 therebetween. The inner circumferential surface of the belt member 31 is pressed by the heater 33, and thereby the outer circumferential surface of the belt member 31 is pressed against the pressure roller 32. The fixing nip is formed between the outer circumferential surface of the belt member 31 and the outer circumferential surface of the pressure roller 32 pressed against each other.

The pressure roller 32 is formed by laminating an elastic layer and a releasing layer, which is for smooth release, on the outer circumferential surface of the metal core having a pipe-like shape. The pressure roller 32 has a cylindrical shape having an outer diameter of approximately 20-100 mm. The metal core of the pressure roller 32 is formed from a metal pipe having a thickness of approximately 1.0-10 mm and made of, for example, aluminum or steel. The elastic layer of the pressure roller 32 is made of high heat-resistance elastic material such as silicone rubber or fluorine-containing rubber, and has a thickness of approximately 1-20 mm.

The releasing layer of the pressure roller 32 is fluorine-containing tube or fluorine-containing coating, made of PFA (tetrafluoroethylene-perfluoroalkylvinylether copolymer), PTFE (polytetrafluoroethylene), ETFE (tetrafluoroetylene-ethylene copolymer) or the like. The releasing layer has a thickness of approximately 5-100 μm. Note that the releasing layer may have electrical conductivity.

In this Embodiment, the pressure roller 32 is made by laminating a silicone rubber elastic layer having a thickness of 3 mm on the metal core of aluminum, and fitting a PFA tube having a thickness of 30 μm onto the outer circumferential surface of the elastic layer. Thus, the pressure roller 32 has an outer diameter of 20 mm.

The pressure roller 32 is rotated by a motor, which is not depicted in the drawing, in the direction indicated by the arrow D in FIG. 2. The belt member 31 pressed by the pressure roller 32 generates rotational force due to the friction with the pressure roller 32. Thus, the belt member 31 is rotated in the direction indicated by the arrow E in FIG. 2, along with the rotation of the pressure roller 32. The heater 33 is pressed against the inner circumferential surface of the belt member 31. Due to the rotation of the belt member 31, the inner circumferential surface of the belt member 31 slides on the surface of the heater 33.

The belt member 31 is rotated along with the rotation of the pressure roller 32, at almost the same rotation speed as the pressure roller 32. The recording sheet 5, which has been transported to the fixing nip N, passes through the fixing nip N, such that the middle portion of the recording sheet S in the width direction thereof coincides with the middle portion of the fixing nip N in the width direction thereof, which is perpendicular to the moving direction of the recording sheet S.

While the recording sheet S passes through the fixing nip N between the belt member 31 and the pressure roller 32 pressed against each other, the unfixed toner image on the recording sheet S is subject to heat and pressure, and thus the unfixed toner image on the recording sheet S is fixed onto the recording sheet S. The recording sheet S which has passed by the fixing nip N is removed from the belt member 31, and transported to the paper ejecting roller 25 provided in the upper section of the printer, as shown in FIG. 1.

The fixing device 30 is detachable from the main body of the printer, and is replaced with new one when the belt member 31, the heater 33 or the like reaches the end of its life, or when the heater 33 or the like is damaged.

The heat-resistant film included in the belt member 31 is, for example, a heat-resistant single-layer film made of PTFE, PFE or FEP, or a multiple-layer film formed by coating the outer circumferential surface of a film made of; for example, polyimide, polyamide-imide, PEEK, PES or PPS, with, for example, PTFE, PFE or FEP. The heat-resistant film is formed to have a thickness of 100 μm in order to reduce the heat capacity of the belt member 31 and thereby increase the rate of temperature increase. The belt member 31 has a cylindrical shape with an outer diameter of 18 mm, for example.

Figure 3:
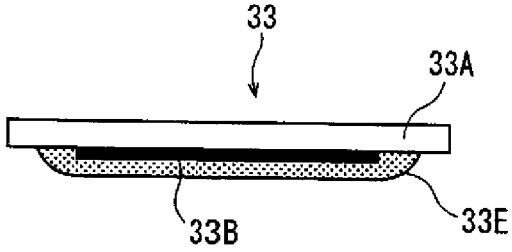
FIG. 3 is a schematic side view of a heater provided in the fixing device.
Figure 4:
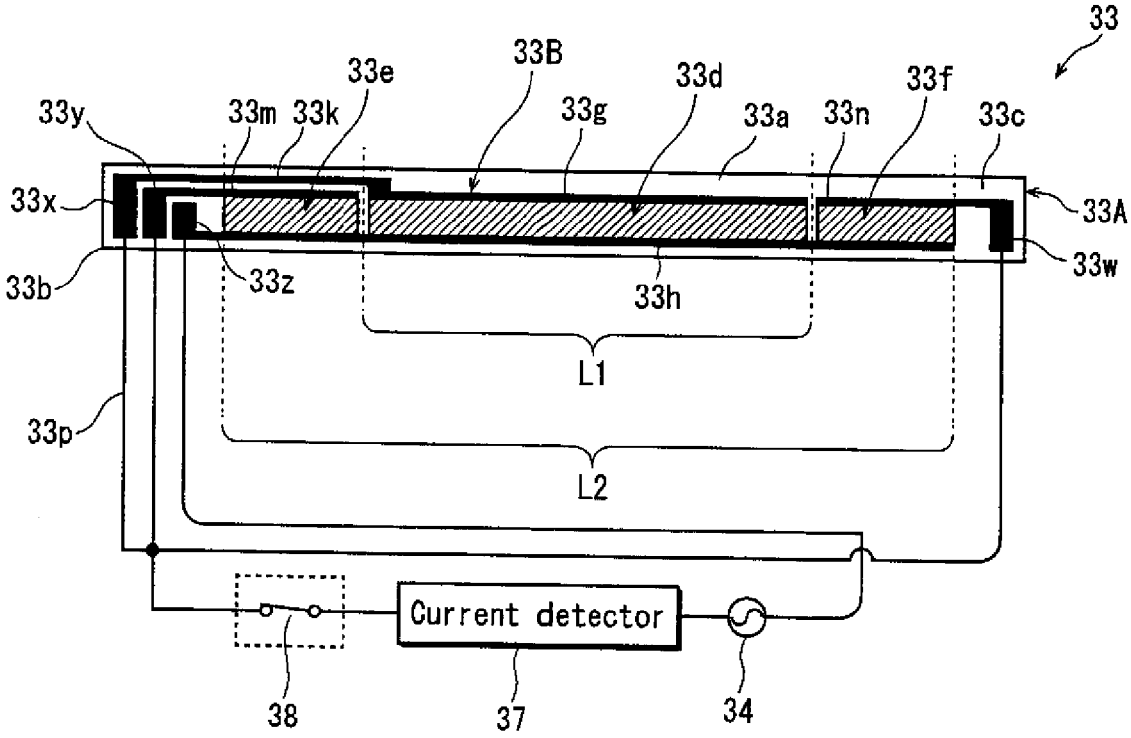
FIG. 4 is a schematic diagram showing a surface of the heater, facing the pressure roller, together with a power supply circuit for the resistance heating element provided in the heater.

FIG. 3 is a schematic side view of the strip-like heater 33 provided inside the rotation area of the belt member 31. FIG. 4 is a schematic diagram showing a surface of the heater 33, facing the pressure roller 32, together with a power supply circuit for the heater 33. Note that the heater 33 in FIG. 4 is reduced in size in comparison with FIG. 3.

As shown in FIG. 3, the heater 33 includes a supporting substrate 33A, a resistance heater part 33B, and an overcoat layer 33E. The supporting substrate 33A is an insulative strip-like member, and is provided along the direction perpendicular to the transport direction of the recording sheet S. The resistance heater part 33B is provided on the surface of the supporting substrate 33A which faces the pressure roller 32. The overcoat layer 33E is provided on the 33 supporting substrate 33A so as to cover the resistance heater part 33B. Note that the overcoat layer 33E is omitted from FIG. 4.

The supporting substrate 33A of the heater 33 is held by a holding member, which is not illustrated in the drawing, such that the longitudinal direction of the supporting substrate 33A is in parallel with the shaft center of the pressure roller 32. The holding member is rigid and heat-resistant, and is made of, for example, polyimide, polyamide-imide, PEEK, PES, PPS or liquid crystal polymer. The holding member also serves as a guide for the belt member 31.

The supporting substrate 33A is made of a ceramic material that is heat-resistant, insulative, and highly heat-conductive. Specifically, the supporting substrate 33A is made of alumina, aluminum nitride, or the like. In this Embodiment, the supporting substrate 33A is made of alumina so as to have a length of 260 mm, a width of 7 mm, and a thickness of 1.5 mm.

The resistance heater part 33B is made of a resistance heating material, which generates Joule heat when supplied with current. As shown in FIG. 4, the resistance heater part 33B includes a central heating area 33*d*, a first end heating area 33*e* and a second end heating area 33*f*. The central heating area 33*d* is provided in a substrate central portion 33*a* of the supporting substrate 33A, which is a portion of the supporting substrate 33A excluding both ends in the longitudinal direction. The first end heating area 33*e* and the second end heating area 33*f* are respectively provided in a substrate first end portion 33*b* and a substrate second end portion 33*c* at both ends of the supporting substrate 33A in the longitudinal direction.

The resistance heater part 33B is formed as thick films made from a resistance heating material with a positive resistance-temperature characteristic (PTC characteristic). In this case, the first end heating area 33*e* and the second end heating area 33*f* have been subject to patterning such that they have the same shape and thereby have the same PTC characteristic and the same electrical resistance.

Note that FIG. 4 does not show the detailed pattern shapes of the central heating area 33*d*, the first end heating area 33*e* and the second end heating area 33*f*. The pattern shapes of the heating areas 33*d*, 33*e* and 33*f* are not limited to any particular shape, and any shapes are acceptable as long as the sheet resistivity is uniform and the whole area exhibits a predetermined electrical resistivity.

The central heating area 33*d* is provided between a feeder wiring pattern 33*g* and a common wiring pattern 33*h* so as to be capable of conducting electrical power. The feeder wiring pattern 33*g* is provided along one side edge of the central portion of the substrate central portion 33*a* in the longitudinal direction. The common wiring pattern 33*h* is provided along almost the whole length of the other side edge of the supporting substrate 33A in the longitudinal direction. The feeder wiring pattern 33*g* is connected to a connection wiring pattern 33*k* which is provided along one side edge of the substrate first end portion 33*b* in the longitudinal direction. An end of the connection wiring pattern 33*k* is connected to a first electrode 33*x* which is provided at an outside end of the substrate first end portion 33*b* in the longitudinal direction.

The first end heating area 33*e* provided in the substrate first end portion 33*b* is provided across a first end feeder wiring pattern 33*m* and the common wiring pattern 33*h* described above, so as to be capable of conducting electrical power. The first end feeder wiring pattern 33*m* is provided along one side edge of the substrate first end portion 33*b* in the longitudinal direction. An end of the first end feeder wiring pattern 33*m* is connected to a second electrode 33*y*. The second electrode 33*y* is provided inside the first electrode 33*x* at the outside end of the substrate first end portion 33*b* in the longitudinal direction.

Note that the end of the common wiring pattern 33*h* on the substrate first end portion 33*b* is connected to a common electrode 33*z* which is provided inside the second electrode part 33*y*.

The second end heating area 33*f* provided in the substrate second end portion 33*c* is provided across a second end feeder wiring pattern 33*n* and the common wiring pattern 33*h* described above, so as to be capable of conducting electrical power. The second end feeder wiring pattern 33*n* is provided along one side edge of the substrate second end portion 33*c* in the longitudinal direction. An end of the second end feeder wiring pattern 33*n* is connected to a third electrode 33*w*. The third electrode 33*w* is provided at the outside end of the substrate second end portion 33*c* in the longitudinal direction.

Each of the central heating area 33*d*, the first end heating area 33*e* and the second end heating area 33*f* are formed from, for example, ceramic material such as barium titanate or conductive polymer with dispersed carbon, so that the areas have a predetermined PTC characteristic.

Figure 5:
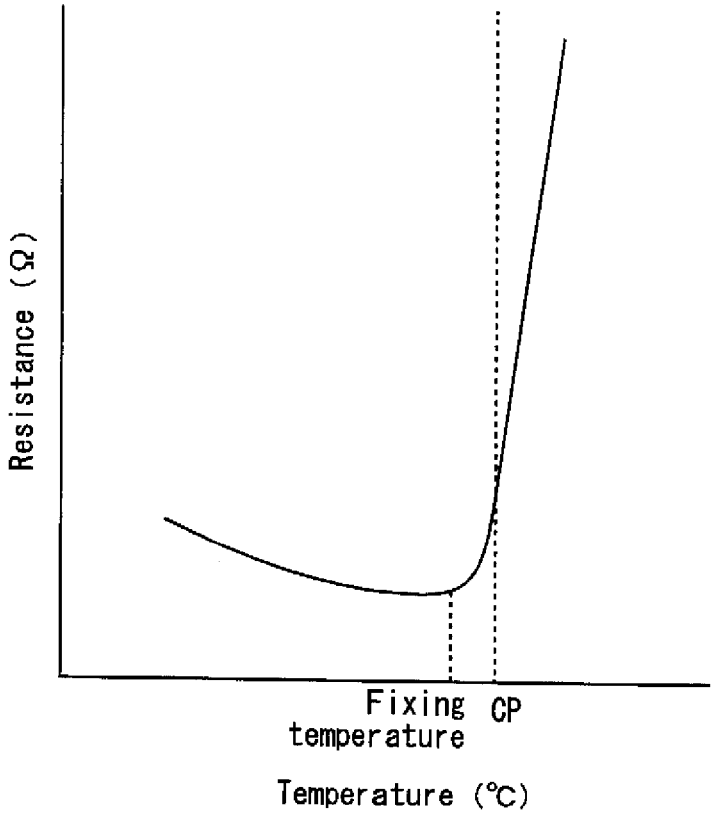
FIG. 5 is a graph showing the relationship between the temperature of the resistance heater part provided in the heater and the value of resistance.

FIG. 5 is a graph showing the PTC characteristic of the entire resistance heater part 33B. The central heating area 33*d*, the first end heating area 33*e* and the second end heating area 33*f* have the same PTC characteristic. Hence, although changes in resistance are small until the temperature reaches the Currier point (CP), the resistance sharply (non-linearly) rises when the temperature exceeds the Curie point (CP), and consequently the amount of current flow is decreased in a temperature range above the Curie point (CP). In this Embodiment, the resistance heater part 33B has the Curie point (CP) at 200° C. (the upper limit), which is higher than the fixing temperature (180° C.), and the operation range of the PTC thermistor has been determined such that the resistance is at the lowest when the temperature of the PTC thermistor is near the fixing temperature (180° C.).

As shown in FIG. 4, the length L1 of the central heating area 33*d* provided in the substrate central portion 33*a*, in the longitudinal direction of the supporting substrate 33A (the direction perpendicular to the transport direction of the recording sheet S), corresponds to the length of the supporting substrate 33A in the longitudinal direction when the size of the recording sheet S, which passes through the fixing nip N, is minimum. In this Embodiment, the length L1 is the length of common envelopes in the longitudinal direction (118 mm).

The length L2 in the longitudinal direction of the supporting substrate 33A between the outer end of the first end heating area 33*e* provided in the substrate first end portion 33*b* in the longitudinal direction and the outer end of the second end heating area 33*f* provided in the substrate second end portion 33*c* in the longitudinal direction corresponds to the length of the supporting substrate 33A in the longitudinal direction when the size of the recording sheet S, which passes through the fixing nip N, is at the maximum. In this Embodiment, the length L2 is the length of LTR size (letter size) in the longitudinal direction (216 mm).

The overcoat layer 33E provided on the supporting substrate 33A is formed from heat-resistant resin, glass, or the like, so as to cover the entire surface of the resistance heater part 33B. In this Embodiment, the overcoat layer 33E is made from heat-resistant glass layer having a thickness of 60 μm so that the overcoat layer 33E is electrically insulative and easily slide on the belt member 31.

As shown in FIG. 4, the first electrode 33*x*, the second electrode 33*y*, the third electrode 33*w* and the common electrode 33*z* are supplied with alternating current from a commercial AC power source 34. The first electrode 33*x*, the second electrode 33*y* and the third electrode 33*w* are connected in parallel, and alternating current from the power source 34 is supplied to the first electrode 33*x*, the second electrode 33*y* and the third electrode 33*w* in parallel via a current detector 37 and a switching device 38.

The current detector 37 is composed of, for example, a current transformer. The switching device 38 is a normally-closed contact, and the current supply to all of the central heating area 33*d*, the first end heating area 33*e* and the second end heating area 33*f* of the resistance heater part 33B is blocked when the switching device 38 is OFF (opened).

The electrical resistance of the parallel heating areas 33*d*, 33*e* and 33*f* is set at approximately 10Ω in total at room temperature (25° C.), so that the heating areas 33*d*, 33*e* and 33*f* generate approximately 1000 W when an alternating current (AV) of 100V is applied, for example.

The feeder wiring pattern 33*g*, the connection wiring pattern 33*k*, the first electrode 33*x*, the first end feeder wiring pattern 33*m*, the second electrode 33*y*, the common wiring pattern 33*h*, the common electrode 33*z*, the second end feeder wiring pattern 33*n* and the third electrode 33*w*, which are for supplying current to the heating area 33*d*, 33*e* and 33*f*, are each made from a material with resistivity that is low enough compared to the heating area 33*d*, 33*e* and 33*f* (e.g. Ag, Cu). In this Embodiment, screen printing of Ag is adopted.

As shown in FIG. 5, while the temperature of the PTC heating areas 33*d*, 33*e* and 33*f* of the heater 30 with the stated structure is lower than the fixing temperature (180° C.), the electrical resistivity gradually decreases as the temperature increases. Accordingly, the amounts of current supplied to the heating areas 33*d*, 33*e* and 33*f* increase, and their respective temperatures increase.

Figure 6:
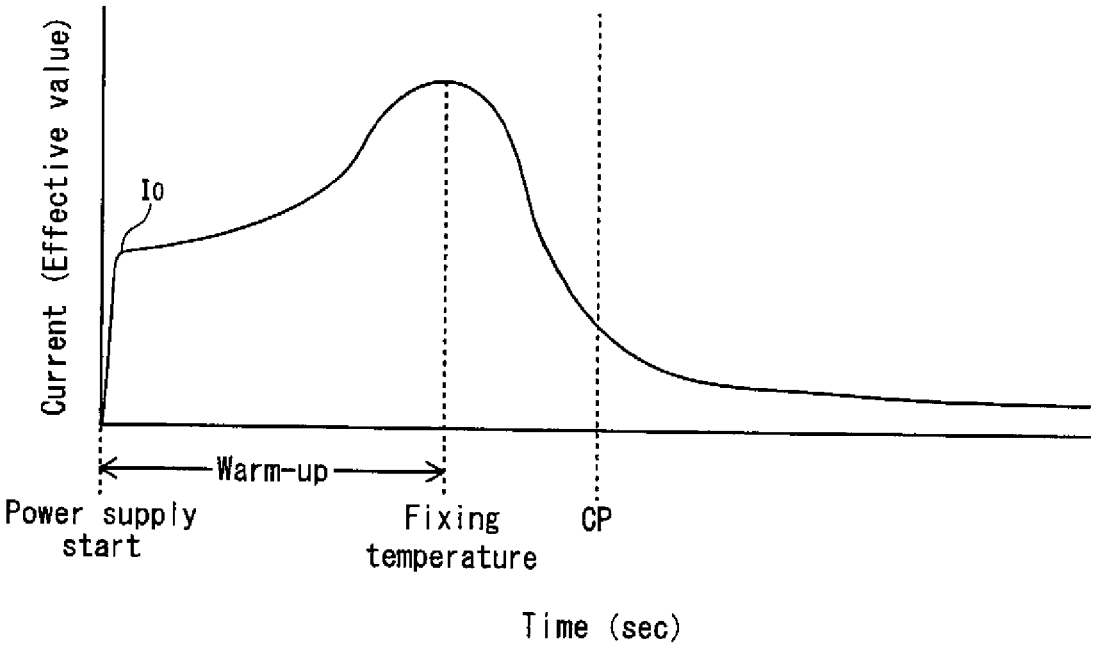
FIG. 6 is a graph showing changes in the current (effective value) when the resistance heater part of the heater is supplied with power.

FIG. 6 is a graph showing changes in the current (effective value) when the central heating area 33*d*, the first end heating area 33*e* and the second end heating area 33*f* of the resistance heater part 33B of the heater 33 are supplied with power, starting from room temperature (25° C.). Note that FIG. 6 shows the changes in the current (effective value) of the resistance heater part 33B over time while the recording sheet S is not being transported to the fixing nip N.

As shown in FIG. 6, upon receiving alternating current from the power source 34, the resistance heater part 33B instantly enters (no longer than 10 ms) into a state in which power is stably supplied to the resistance heater part 33B (stable power supply state). The current at the beginning of the stable power supply state is denoted as the initial current Io.

After entering into the stable power supply state, the heating areas 33*d*, 33*e* and 33*f* of the resistance heater part 33B increase in temperature by generating heat according to the power supply. Consequently, the heating areas 33*d*, 33*e* and 33*f* decrease in resistance (See FIG. 5), the amount of current supplied to the resistance heater part 33B gradually increases.

As shown in FIG. 6, the time (warm-up time) from the start of power supply to when the temperature of the resistance heater part 33 reaches the fixing temperature (180° C.) has been determined in advance. Fixing of the toner image onto the recording sheet S will be performable after the warm-up time has elapsed from the beginning of the stable power supply state. After the elapse of the warm-up time, the printer starts the image formation operation and the fixing device 30 starts the fixing onto the recording sheet S transported to the fixing nip N.

While the recording sheet S is not transported to the fixing nip N, the temperature of the entire resistance heater part 33B rises. The resistance of the entire resistance heater part 33B is at the minimum when its temperature reaches the fixing temperature (180° C.) as shown in FIG. 5, and the current flowing the entire resistance heater part 33B is at the maximum as shown in FIG. 6. After that, when the temperature reaches the Curie point (CP), the resistance heater part 33B having the PTC characteristic sharply increases in resistance as shown in FIG. 5. In the temperature range above the Curie point (CP), current that flows in the resistance heater part 33B is decreased, as shown in FIG. 6. Hence, there is no risk that the temperature of the resistance heater part 33B rises above the Curie temperature (CP).

When the recording sheet S passes through the fixing nip N, the temperature of the resistance heater part 33B decreases, and after the temperature falls to near the fixing temperature, the resistance of the resistance heater part 33B decreases, the current amount increases, and the temperature rises. Even in this case, there is no risk that the temperature of the resistance heater part 33B rises above the Curie point (CP).

Therefore, the temperature of the resistance heater part 33B having the PTC characteristic is adjusted to be within the range from near the fixing temperature to the Curie temperature (CP) when the recording sheet S passes through the fixing nip N even without any temperature detection element such as a thermistor for detecting the temperatures of the heating areas 33*d*, 33*e*, 33*f*.

When, for example, a recording sheet S with the minimum size (envelope size) passes through the fixing nip N, the recording sheet S does not pass through the substrate first end portion 33*b* and the substrate second end portion 33*c* of the supporting substrate 33A. Thus, heat generated by the first end heating area 33*e* and the second end heating area 33*f* of the resistance heater part 33B having the PTC characteristic is not absorbed by the recording sheet S. Hence, the temperatures of the first end heating area 33*e* and the second end heating area 33*f* increase.

Consequently, when a plurality of recording sheets S with the minimum size sequentially pass through the fixing nip, the temperatures of the first end heating area 33*e* and the second end heating area 33*f* keep increasing. However, even in this case, the amount of power supplied to the first end heating area 33*e* and the second end heating area 33*f* sharply drops when the temperatures thereof rise above the Curie point (CP), and the increase in the temperatures of the first end heating area 33*e* and the second end heating area 33*f* is suppressed. Thus, excessive increase in temperature of the end heating areas of the resistance heater part 33B is prevented.

The Curie points (CP) of the central heating area 33*d*, the first end heating area 33*e* and the second end heating area 33*f* are not limited to any particular value. The Curie points are set based on the fixing temperature determined by the physical property and the likes of toner.

Note that the printer is designed to enter a power save mode (sleep mode) for reducing power supply from the power source 34 to the resistance heater part 33B of the heater 33 in the fixing device 30 when no printing instruction has been made for a predetermined time. After the fixing device 30 enters into the sleep mode, power supply to the resistance heater part 33B is reduced, and consequently the temperature of the resistance heater part 33B decreases to room temperature.

Due to such a structure, there is a risk that the heater 33 enters into an abnormal state where any of the central heating area 33*d*, the first end heating area 33*e* and the second end heating area 33*f* of the resistance heater part 33B is ruptured or partially damaged due to "cracks" or the likes in the supporting substrate 33A. In such an abnormal state, the heater 33 can not keep the temperature of the resistance heater part 33B at the fixing temperature, which could lead to fixing failure of the toner image on the recording sheet S, for example.

In view of the above, the present Embodiment has a structure for performing abnormality detection control, which is for detecting an abnormality in the resistance heater part 33B of the heater 33. In the abnormality detection control, the occurrence of an abnormality in the resistance heater part 33B is determined based on the initial current supplied to the resistance heater part 33B.

Figure 7:
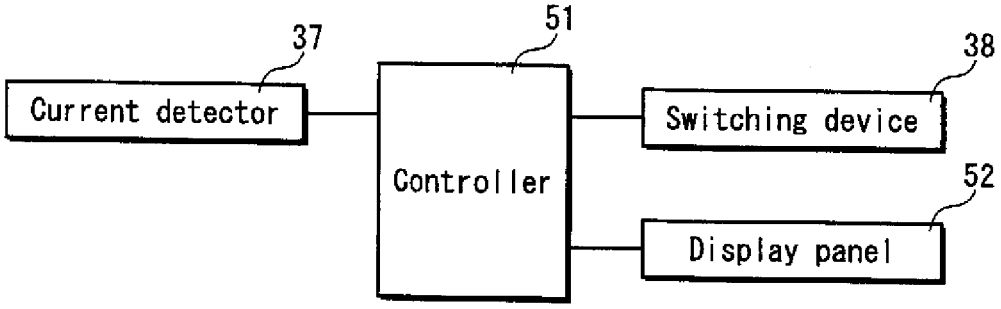
FIG. 7 is a block diagram showing a control system used for performing abnormality detection control for detecting an abnormality in the resistance heater part of the heater provided in the fixing device.

FIG. 7 is a block diagram showing a control system for performing the abnormality detection control. The abnormality detection control is performed by a controller 51 which includes a CPU, a RAM, a ROM, and so on. FIG. 7 shows only main components of the controller 51 for controlling the fixing device 30.

The controller 51 is supplied with output from the current detector 37 which measures the total current amount supplied to the central heating area 33*d*, the first end heating area 33*e* and the second end heating area 33*f* of the resistance heater part 33B connected in parallel. When detecting an abnormality based on the output from the current detector 37, the controller 51 turns off (i.e. opens) the switching device 38 provided between the power source 34 and each of the central heating area 33*d*, the first end heating area 33*e* and the second end heating area 33*f*.

The following explains the principle of the abnormality detection control performed by the controller 51.

When the resistance heater part 33B with the PTC characteristic has no abnormality, the current sharply rises when power supply from the power source 34 is started, and reaches the initial current Io. After that, the resistance heater part 33B will be stably supplied with current (see FIG. 6).

In contrast, if the heater 33 enters into the abnormal state where any of the central heating area 33*d*, the first end heating area 33*e* and the second end heating area 33*f* of the resistance heater part 33B is ruptured or partially damaged due to "cracks" or the likes in the supporting substrate 33A, the resistance increases in any of the heating areas 33*d*, 33*e* and 33*f* arranged in parallel, and accordingly the current supplied to the entire resistance heater part 33B decreases. Consequently, in the case where the heater 33 has an abnormality, the current in the stable power supply state is lower than the initial current in the case where the heater 33 has no abnormality.

In view of the above, the controller 51 beforehand assigns, as a threshold current Ith, the initial current Io, which is to be supplied to the resistance heater part 33B having no abnormality, and monitors, for a predetermined period, the current supplied to the resistance heater part 33B in the stable power supply state after the beginning of the power supply thereto. Thus, the controller 51 determines that the resistance heater part 33B has an abnormality when the minimum value Is of the detected current is lower than the initial current Io (Is<Io).

Upon receiving power, the resistance heater part 33B instantly (in approximately 10 ms) enters into the stable power supply state, and accordingly the temperature of the resistance heater part 33B starts increasing. Consequently, the resistance of the resistance heater part 33B decreases as shown in FIG. 5, and accordingly, the current amount supplied to the resistance heater part 33B gradually increases as shown in FIG. 6. For this reason, in this Embodiment, the time at which the current supplied to the resistance heater part 3313 is detected is set to a time between 20 msec after the beginning of the power supply and 300 msec after the beginning of the power supply.

When 20 msec has elapsed since the beginning of the power supply, the resistance heater part 33B has certainly been in the stable power supply state, and there is no risk that the current is measured in the course of rising of the power supplied to the resistance heater part 33B. Also, before 300 msec has elapsed since the beginning of the power supply, there has been almost no rise in the temperature of the resistance heater part 33B. Hence, changes in the current due to such a rise are ignorable, and hardly affect the determination of an abnormality in the resistance heater part 33B. Furthermore, if the minimum current within the range of 20 msec to 300 msec from the beginning of the power supply is measured, the controller 51 can more effectively avoid the influence of the temperature raise and improves the accuracy of the abnormality determination.

Similarly, as for the initial current Io to the resistance heater part 33B having no abnormality, the current supplied to the resistance heater part 33B is measured within a period from 20 msec to 300 msec from the beginning of the power supply, and the minimum of the measured current is determined as the initial current Io.

Figure 8:
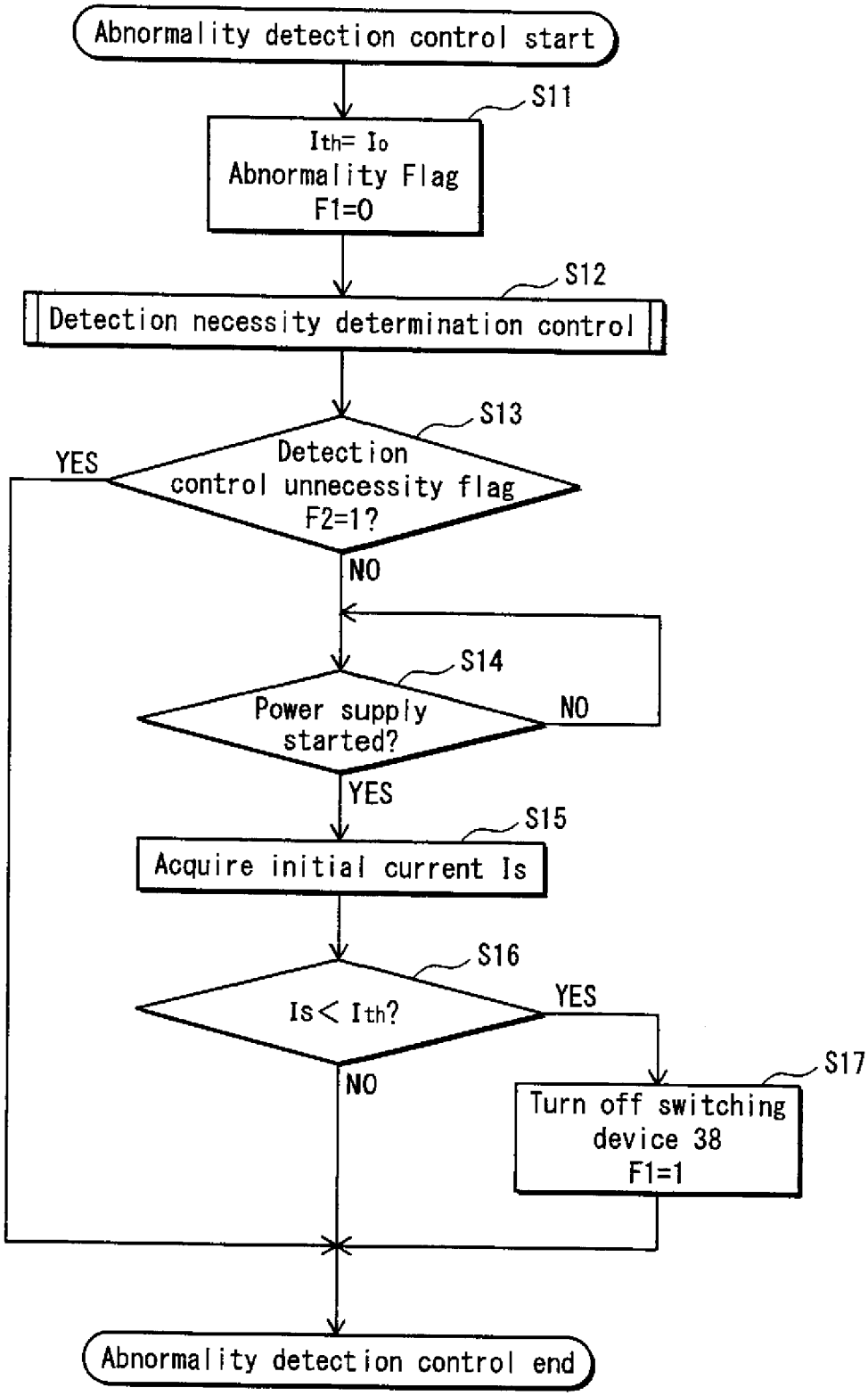
FIG. 8 is a flowchart showing processing procedures for abnormality detection control performed by a controller.

FIG. 8 is a flowchart showing processing procedures for the abnormality detection control performed by the controller 51. The abnormality detection control is started when an instruction to start the power supply to the resistance heater part 33B is provided by issuance of an instruction to execute a print job, for example.

At the beginning of the abnormality detection control, the controller 51 determines the threshold current Ith for the use in the abnormality detection, and turns off an abnormality flag F1 (F1=0) (See Step S11 in FIG. 8. Each step number below similarly refers to the number of the corresponding step in FIG. 8). The abnormality flag F1 indicates the occurrence of an abnormality. The threshold current Ith is set to the initial current Io (Ith=Io). The initial current Io indicates the current at the beginning of power supply when the resistance heater part 33B of the heater 33 has no abnormality.

Note that the initial current Io varies according to the material compositions, sizes, etc. of the central heating area 33*d*, the first end heating area 33*e* and the second end heating area 33*f* of the resistance heater part 33B. Hence, the initial current Io supplied to the resistance heater part 33B of the heater 33 at 25° C. (room temperature) is measured in each fixing device 30 as a product manufactured in a factory or the like. Then, at the factory shipment, or replacement of the fixing device 30, the initial current Io measured in the fixing device 30 is written into RAM of the controller 51 as the threshold current Ith by a factory worker, an engineer, or the like. Note that the room temperature is not limited to 25° C., and may be any temperature within the range approximately from 20° C. to 30° C.

After the threshold current Ith is set to the initial current Io that is unique to the fixing device 30 and the abnormality flag F1 is turned off in Step S11, the controller 51 performs detection necessity determination control for determining the necessity for the abnormality detection control (Step S12). The detection necessity determination control is performed for determining whether or not the fixing device 30 is in a fit state to properly detect an abnormality by the abnormality detection control.

In the abnormality detection control, an abnormality is detected based on the initial current Io supplied to the resistance heater part 33B of the heater 33 in the fixing device 30. Since the initial current Io is set to the current at room temperature (25° C.) and the resistance heater part 33B has the PTC characteristic, there is a possibility that the results of the abnormality detection control based on the initial current Io are not accurate when the temperature of the resistance heater part 33B is different from the room temperature (25° C.).

Thus, in the detection necessity determination control, a detection control unnecessity flag F2, which indicates that the abnormality detection is unnecessary, is set to ON (F2=1) when the temperature of the resistance heater part 33B is different from the room temperature (25° C.), so that the abnormality detection control will not be performed. The detection necessity determination control will be described later.

After the detection necessity determination control is performed in Step S12, Step S13 is performed. In Step S13, whether the flag F2, which indicates that the abnormality detection is unnecessary, is ON (F2=1) or not is determined.

If the flag F2 is ON (F2=1) in Step S13 ("YES" in Step S13), the controller 51 ends the abnormality detection control at that point without performing the subsequent processing. If the flag F2 is OFF (F2=0) ("NO" in Step S13) and is not ON (F2=1), the processing proceeds to Step S14, and the controller 51 enters into a standby state and waits until power supply to the resistance heater part 33B is started.

After that, when the power source 34 starts supplying alternating current to the resistance heater part 33B ("YES" in Step S14), the controller 51 acquires the initial current Is based on the output from the current detector 37 (Step S15). This initial current Is is, as described above, the minimum current detected within a period from the time point 20 msec after the beginning of power supply to the time point 300 msec after the beginning of power supply to the resistance heater part 33B. By setting the initial current Is to the minimum current, detection errors in the resistance heater part 33B can be reduced.

Next, the controller 51 compares the acquired initial current Is with the threshold current Ith (i.e. the initial current Io in the resistance heater part 3313 having no abnormality) (Step S16). If the acquired initial current Is is lower than the threshold current Ith (=Io) (Is<Ith, "YES" in Step S16), the controller 51 determines that an abnormality has occurred in the resistance heater part 33B is. If this is the case, the controller 51 turns off (i.e. opens) the switching device 38 to cut off the power supply to the resistance heater part 33B, and turns on the abnormality flag F1 (F1=1) (Step S17). Then, the controller 51 ends the abnormality detection control.

When the abnormality flag F1 is ON (F1=1), the controller 51 stops operations of the image formation section A and so on, in order to stop execution of print jobs. Also, the controller 51 shows a notification indicating that an abnormality has occurred in the heater 33 of the fixing device 30, on a display panel 52 included in the operation panel. With these operations, the heater 33 is prevented from performing fixing if an abnormality has occurred in it. Accordingly, images with low quality due to fixing failure or the like are prevented from being printed.

In Step S11, when the abnormality flag F1 is OFF (F1=0), turning off of the switching device 38, the prohibition of the print operations and the notification on the display panel 52 of the abnormality in the heater 33 are all cancelled.

When an engineer replaces the fixing device 30 with a new fixing device having a heater 33 having no abnormality, the engineer sets the threshold current Ith to the initial current Io in the resistance heater part 33B of the heater 33 in the new fixing device 30, which has been measured in advance.

In Step S16, if the acquired initial current Is is not lower than the threshold current Ith (=Io), (Io≤Is, "NO" in Step S16), the controller 51 determines that no abnormality has occurred in the resistance heater part 33B, and ends the abnormality detection control.

Figure 9:
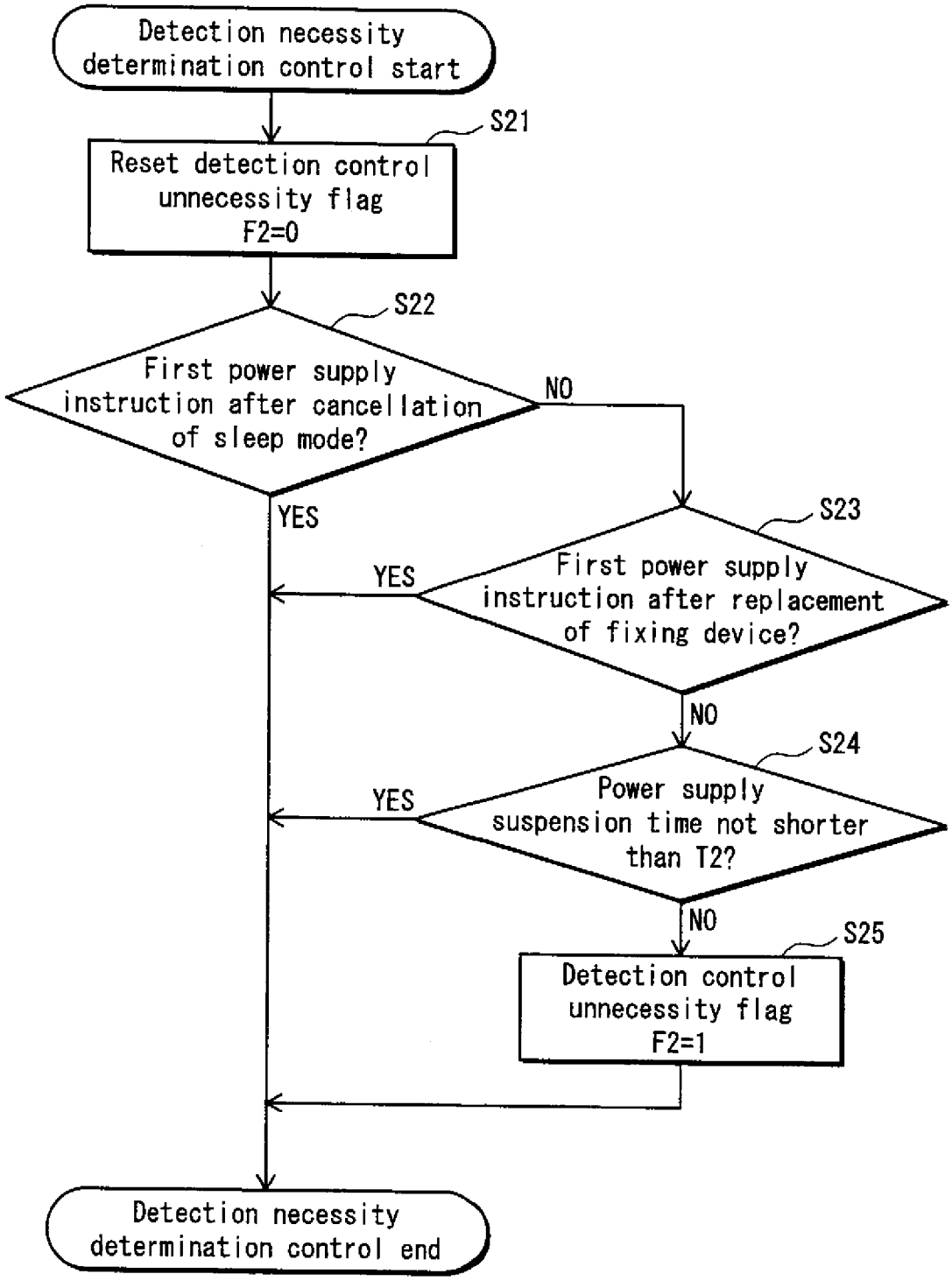
FIG. 9 is a flowchart showing processing procedures for determining the need for the abnormality detection included in the flowchart in FIG. 8.

FIG. 9 is a flowchart showing processing procedures of detection necessity determination control performed in Step S12 in the flowchart in FIG. 8. In the detection necessity determination control, the controller 51 first turns off the flag F2 (F2=0) (Step S21 in FIG. 9. Each step number below similarly refers to the number of the corresponding step in FIG. 9).

Next, the controller 51 determines whether the abnormality detection control is the one triggered by the first power supply instruction after cancellation of the sleep mode (power save mode) (i.e. the power supply instruction responding to the first print instruction after cancellation of the sleep mode) (Step S22). If the abnormality detection control is the one triggered by the first power supply instruction after cancellation of the sleep mode ("YES" in Step S22), the controller 51 determines that the temperature of the resistance heater part 33B has reached the room temperature during the sleep mode and the abnormality detection control is executable. Accordingly, the controller 51 ends the detection necessity determination control, keeping the flag F2 in the OFF state (F2=0), and proceeds to Step S13 in FIG. 8.

If the abnormality detection control is not the one triggered by the first power supply instruction after cancellation of the sleep mode ("NO" in Step S22), the controller 51 determines that print operations have already been performed, and proceeds to Step S23. In Step S23, the controller 51 determines whether the abnormality detection control is the one triggered by the first power supply instruction after replacement of the fixing device 30 (Step S23). If the abnormality detection control is the one triggered by the first power supply instruction after replacement of the fixing device 30 ("YES" in Step S23), the controller 51 determines that the temperature of the resistance heater part 33B of the newly attached fixing device 30 has reached the room temperature and the abnormality detection control is executable. Accordingly, the controller 51 ends the detection necessity determination control, keeping the flag F2 in the OFF state (F2=0), and proceeds to Step S13 in FIG. 8.

If the abnormality detection control is not the one triggered by the first power supply instruction after replacement of the fixing device 30 ("NO" in Step S23), the controller 51 proceeds to Step S24. In Step S24, the controller 51 determines whether the time for which power supply to the resistance heater part 33B of the heater 33 has been suspended is not shorter than a predetermined time T2. The predetermined time T2 is a time required for the temperature of the resistance heater part 33B of the heater 33, which has reached the fixing temperature due to power supply to the resistance heater part 33B, to drop to the room temperature (25° C.).

If the time for which power supply to the resistance heater part 33B of the heater 33 has been suspended is shorter than the predetermined period T2 (sec) ("NO" in Step S24), the controller 51 turns on the flag F2 (F2=1) (Step S25), ends the detection necessity determination control, and proceeds to Step S13 in FIG. 7.

If the time for which power supply to the resistance heater part 33B of the heater 33 has been suspended is not shorter than the predetermined period T2 (sec) ("YES" in Step S24), the controller 51 ends the detection necessity determination control, keeping the flag F2 in the OFF state (F2=0), and proceeds to Step S13 in FIG. 7.

In Step S24, if the time for which power supply to the resistance heater part 33B of the heater 33 has been suspended is shorter than the predetermined period T2 ("NO" in Step S24), the controller 51 turns on the flag F2 (F2=1) (Step S25), and then ends the detection necessity determination control. On the other hand, if the time for which power supply to the resistance heater part 33B of the heater 33 has been suspended is not shorter than the predetermined period T2 ("NO" in Step S24), the controller 51 ends the detection necessity determination control without turning on the flag F2.

As described above, if the abnormality detection control is not the one triggered by the first power supply instruction after cancellation of the sleep mode or the one triggered by the first power supply instruction after replacement of the fixing device 30, it can be determined that print operations have already been performed, and that the resistance heater part 33B of the fixing device 30 has been heated to the fixing temperature. Therefore, at a later time point, if the temperature of the resistance heater part 33B has not dropped to the room temperature, the resistance of the resistance heater part 33B is different from the resistance at the room temperature. If the initial current Io is measured under such a condition and is compared with the initial current Io that is a normal value measured at the room temperature, an abnormality in the resistance heater part 33B can not be detected correctly.

Thus, if the abnormality detection control is not the one triggered by the first power supply instruction after cancellation of the sleep mode or the one triggered by the first power supply instruction after replacement of the fixing device 30, the controller 51 determines that an abnormality in the resistance heater part 33B can not be detected correctly when the time for which power supply to the resistance heater part 33B of the heater 33 has been suspended is shorter than the predetermined period T2, and turns on the flag F2 (F2=1) so that the abnormality detection control will not be performed.

As described above, the detection necessity determination control is performed in Step S12 in FIG. 8, and therefore the abnormality detection control is not performed based on the initial current Is measured at the beginning of power supply under the condition where the temperature of the resistance heater part 33B has not reached the room temperature. This prevents misdetection of an abnormality in the resistance heater part 33B by the abnormality detection control due to that the temperature of the resistance heater part 33B is not equal to the room temperature, and improves the accuracy of the abnormality detection control.

In the detection necessity determination control shown in the flowchart in FIG. 9, the controller 51 determines whether the time for which power supply to the resistance heater part 33B of the heater 33 has been suspended is not shorter than the predetermined time T2 (Step S24) after determining whether the abnormality detection control is the one triggered by the first power supply instruction after cancellation of the sleep mode (Step S22) and determining whether the abnormality detection control is the one triggered by the first power supply instruction after replacement of the fixing device 30 (Step S23). However, the controller 51 may proceed to Step S24 to determine whether the time for which power supply to the resistance heater part 33B of the heater 33 has been suspended is not shorter than the predetermined time T2 without performing one of or either of Steps S22 and S23, to determine the necessity of the abnormality detection control by determining whether the time for which power supply to the resistance heater part 33B of the heater 33 has been suspended is not shorter than the predetermined time T2. Note that when the room temperature is set to be different from 25° C., the predetermined time T2 is set to the time corresponding to the temperature.

<Modifications>

In the abnormality detection control in the Embodiment above, the current that flows in the resistance heater part 33B immediately after the power supply start is determined as the initial current Is, and the minimum current within a predetermined period after the current supplied to the resistance heater part 33B has entered the stable power supply state is acquired. However, such a structure is not essential. For example, a period in which the current supplied to the resistance heater part 33B is in the stable power supply state and the changes in the resistance heater part is obviously small may be designated, and a current acquired within this period may be determined as the initial current Is.

In the Embodiment above, the fixing device 30 has a structure in which the belt member 31 including the heat-resistant film is pressed against the pressure roller 32 by the heater 33 including the resistance heater part 33B, and the fixing nip N is formed between the belt member 31 and the pressure roller 32. However, such a structure is not essential. For example, the fixing nip N may be formed by pressing a pressure belt against the belt member 31.

Alternatively, the heater 33 may have a structure in which the resistance heater part 33B is supported on a supporting substrate 33A having a strip-like shape and the resistance heater part 33B is covered with a heat-resistant film, and the fixing nip N is formed by pressing the resistance heater part 33B against the pressure roller 32 via the heat-resistant film.

In the Embodiment above, a commercial AC power source is used as a power source for the fixing device 30. However, a DC power source may be used instead.

The image formation apparatus pertaining to the present invention is not limited to a tandem color digital printer. The image formation apparatus may be a printer for forming monochrome images. Moreover, the image formation apparatus is not limited to a printer. The present invention is applicable to copiers, MFPs (Multiple Function Peripherals), Fax machines, and so on. In any of these cases, it does not matter whether the image formation apparatus is for color images or for monochrome images.

<Summary of Embodiment>

In the fixing device of the embodiment described above, the abnormality determiner detects an abnormality in the resistance heater part based on the initial current detected by the current detector at a predetermined time after power supply to the resistance heater part has been started. Thus, there is no need for a temperature detection element, such as a thermistor and a thermopile, which makes the fixing device economical. Moreover, since the abnormality detection is performed based on the current at the beginning of power supply to the resistance heater part, the abnormality detection is performed under a condition where the resistance heater part has exhibited almost no temper rise due to the current flow (almost no changes in the resistance). This leads to accurate detection of an abnormality in the resistance heater part.

In the fixing device pertaining to the present embodiment, it is preferable that the abnormality determiner determines that the resistance heater part has an abnormality when the initial current detected by the current detector at the predetermined time is lower than a predetermined threshold.

In the fixing device pertaining to the present embodiment, it is preferable that the predetermined threshold is a normal value of the initial current to be detected when the resistance heater part has no abnormality, the initial current being a current detected by the current detector when a rise time has elapsed since the beginning of power supply to the resistance heater part.

In the fixing device pertaining to the present embodiment, it is preferable that the initial current is a current detected by the current detector when a rise time has elapsed since the beginning of power supply to the resistance heater part.

In the fixing device pertaining to the present embodiment, it is preferable that the abnormality determiner performs the determination only when the temperature of the resistance heater part is equal to room temperature.

In the fixing device pertaining to the present embodiment, it is preferable that the abnormality determiner further determines whether the temperature of the resistance heater part is equal to room temperature, based on a length of a period for which power supply to the resistance heater part has been suspended.

In the fixing device pertaining to the present embodiment, it is preferable that the supporting member has a strip-like shape and is disposed along a direction perpendicular to a transport direction of the recording sheet at the fixing nip, and that the fixing nip is formed between a pressure roller and an endless belt member, the pressure roller being rotatable and facing the resistance heater part, and the belt member being rotatable and passing between the pressure roller and the heater.

In the fixing device pertaining to the present embodiment, it is preferable that the belt member is made of a heat-resistant film.

In the image formation apparatus pertaining to the present embodiment, it is preferable that the fixing device is provided with a power save mode in which power supply to the resistance heater part is reduced, and that the abnormality determiner performs the determination when receiving an initial power supply instruction issued after the fixing device has entered the power save mode, and does not perform the determination when receiving a power supply instruction that is not the initial power supply instruction issued after the fixing device has entered the power save mode.

In the image formation apparatus pertaining to the present embodiment, it is preferable that the fixing device is replaceable, and that the abnormality determiner performs the determination when receiving an initial power supply instruction issued after the fixing device has been replaced, and does not perform the determination when receiving a power supply instruction that is not the power supply instruction issued after the fixing device has been replaced As described above, the Embodiment is useful as a technology for detecting an abnormality in a heater having a resistance heater part which generates heat when supplied with current, without using any temperature detection element.

Although the present invention has been fully described by way of examples with reference to the accompanying drawings, it is to be noted that various changes and modifications will be apparent to those skilled in the art. Therefore, unless such changes and modifications depart from the scope of the present invention, they should be constructed as being included therein.

The invention claimed is:

1. A fixing device for fixing an unfixed toner image formed on a recording sheet by passing the recording sheet through a fixing nip and applying heat and pressure to the recording sheet, the fixing device comprising:

a heater including a resistance heater part and a supporting member, the resistance heater part having a positive resistance-temperature characteristic in a temperature range above a predetermined level and exhibiting a non-linear change in resistance when a temperature thereof exceeds the predetermined level, and the supporting member being insulative and supporting the resistance heater part such that the resistance heater part applies heat to the recording sheet passing through the fixing nip;

a current detector detecting a current supplied to the resistance heater part; and an abnormality determiner determining whether the resistance heater part has an abnormality, based on an initial current detected by the current detector at a predetermined time after a beginning of power supply to the resistance heater part and before the temperature of the resistance heater part reaches the predetermined level;

wherein the abnormality determiner determines whether the resistance heater part has an abnormality only when the temperature of the resistance heater part is equal to room temperature.

2. The fixing device of claim 1, wherein the abnormality determiner determines that the resistance heater part has an abnormality when the initial current detected by the current detector at the predetermined time is lower than a predetermined threshold.

3. The fixing device of claim 2, wherein the predetermined threshold is a normal value of the initial current to be detected when the resistance heater part has no abnormality, the initial current being a current detected by the current detector when a rise time has elapsed since the beginning of power supply to the resistance heater part.

4. The fixing device of claim 1, wherein the initial current is a current detected by the current detector when a rise time has elapsed since the beginning of power supply to the resistance heater part.

5. The fixing device of claim 1, wherein the abnormality determiner further determines whether the temperature of the resistance heater part is equal to room temperature, based on a length of a period for which power supply to the resistance heater part has been suspended.

6. The fixing device of claim 1, wherein the supporting member has a strip-like shape, and is disposed along a direction perpendicular to a transport direction of the recording sheet at the fixing nip, and the fixing nip is formed between a pressure roller and an endless belt member, the pressure roller being rotatable and facing the resistance heater part, and the belt member being rotatable and passing between the pressure roller and the heater.

7. The fixing device of claim 6, wherein the belt member is made of a heat-resistant film.

8. The fixing device of claim 1, wherein the nonlinear change is an increase in resistance.

9. An image formation apparatus having a fixing device for fixing an unfixed toner image formed on a recording sheet by passing the recording sheet through a fixing nip and applying heat and pressure to the recording sheet, the fixing device comprising:

a heater including a resistance heater part and a supporting member, the resistance heater part having a positive resistance-temperature characteristic in a temperature range above a predetermined level and exhibiting a nonlinear change in resistance when a temperature thereof exceeds the predetermined level, and the supporting member being insulative and supporting the resistance heater part such that the resistance heater part applies heat to the recording sheet passing through the fixing nip;

a current detector detecting a current supplied to the resistance heater part; and an abnormality determiner determining whether the resistance heater part has an abnormality, based on an initial current detected by the current detector at a predetermined time after a beginning of power supply to the resistance heater part and before the temperature of the resistance heater part reaches the predetermined level;

wherein the fixing device is provided with a power save mode in which power supply to the resistance heater part is reduced, and the abnormality determiner determines whether the resistance heater part has an abnormality when receiving an initial power supply instruction issued after the fixing device has entered the power save mode, and does not perform the determination when receiving a power supply instruction that is not the initial power supply instruction issued after the fixing device has entered the power save mode.

10. The image formation apparatus of claim 9, wherein the fixing device is replaceable, and the abnormality determiner determines whether the resistance heater part has an abnormality when receiving an initial power supply instruction issued after the fixing device has been replaced, and does not perform the determination when receiving a power supply instruction that is not the power supply instruction issued after the fixing device has been replaced.

11. The image formation apparatus of claim 9, wherein the nonlinear change is an increase in resistance.

* * * * *